United States Patent [19]

Gil

[11] Patent Number: 4,884,986

[45] Date of Patent: Dec. 5, 1989

[54] SWIMMER'S PROPULSION AID

[76] Inventor: Yoram Gil, 1441 S. Beverly Glen Rd., Los Angeles, Calif. 90024

[21] Appl. No.: 245,812

[22] Filed: Sep. 19, 1988

[51] Int. Cl.[4] ..... A63B 31/11; A63B 31/14

[52] U.S. Cl. ..... 441/60

[58] Field of Search ..... 441/60–63, 441/59

[56] References Cited

U.S. PATENT DOCUMENTS

| | | | |
|---|---|---|---|
| 1,237,392 | 8/1917 | Schneider | 441/63 |
| 1,341,290 | 5/1920 | Webster | 441/61 |
| 1,841,904 | 1/1932 | McGowan | 441/61 |
| 4,316,300 | 2/1982 | Lewis | 441/59 |

FOREIGN PATENT DOCUMENTS

| | | | |
|---|---|---|---|
| 1148822 | 12/1957 | France | 441/62 |

*Primary Examiner*—Sherman D. Basinger

*Attorney, Agent, or Firm*—Philip D. Junkins

[57] ABSTRACT

A swimming propulsion aid for attachment to the feet of a swimmer. The assembled swimming aid for each foot includes a foot wing strapped to the foot of the swimmer so as to extend from the inner edge of the foot laterally under the foot sole and outwardly therefrom to provide an enlarged and effective thrust area for pushing action with respect to surrounding water during the leg extension portion of a reciprocating leg stroke by the swimmer. The foot wing may be constructed of a generally rectangular frame member over which is stretched a flexible sheet of fabric or plastic material or constructed of a generally rectangular frame member across which are aligned a multiplicity of parallel louvers pivotal to a closed position during the leg extension portion of the reciprocating leg stroke by the swimmer. Where the foot wing includes a frame member and flexible sheet material the wing is provided with wing pivots aligned with the inside of the swimmer's foot whereby during the leg retraction portion of the reciprocating leg stroke the foot wing swings inwardly into near longitudinal alignment with the leg and inner foot edge. Where the foot wing includes a frame member and pivotal louvers, the louvers pivot to an open position during the retraction portion of the reciprocating leg stroke. Through use of the swimming propulsion aids of the invention the swimmer is more effectively and forcefully propelled through the water.

6 Claims, 2 Drawing Sheets

FIG. 1.
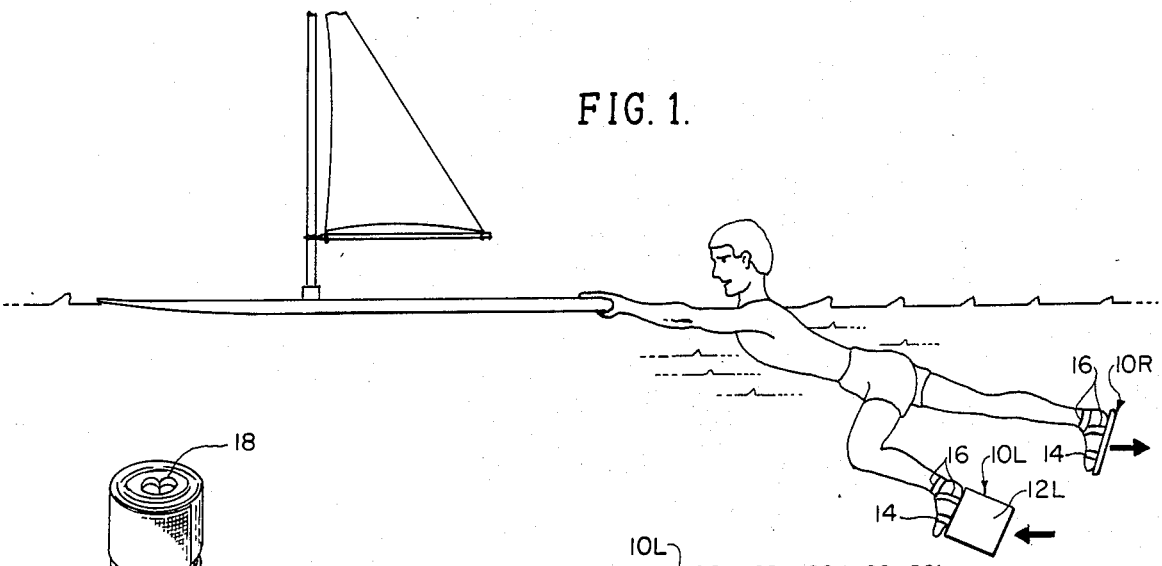
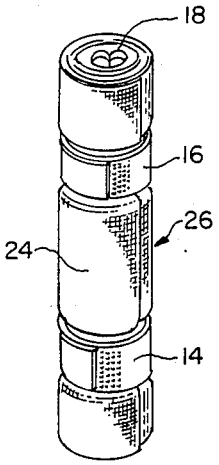
FIG. 2.
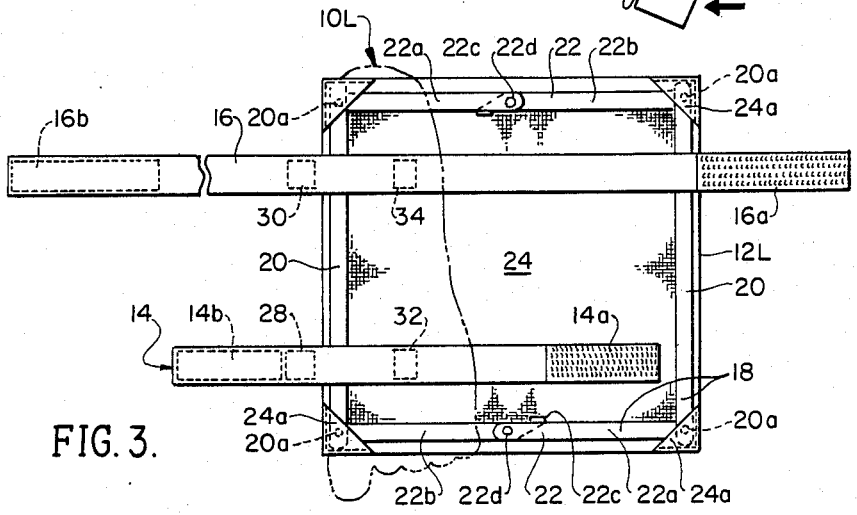
FIG. 3.
FIG. 6.
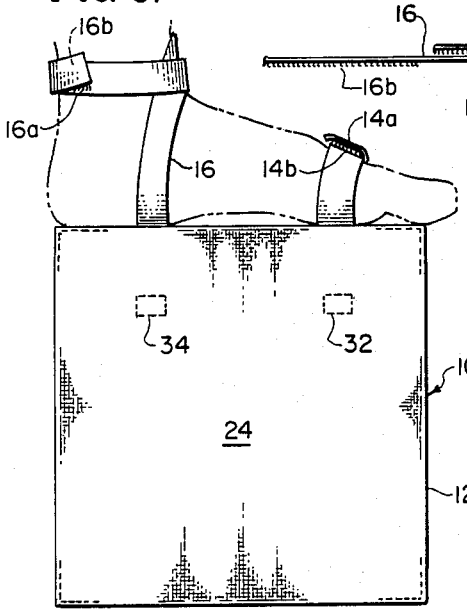
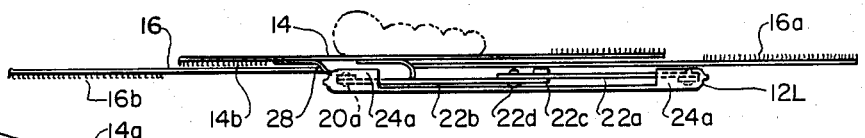
FIG. 4.
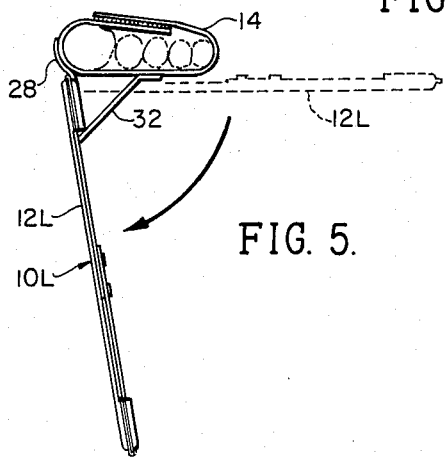
FIG. 5.

SWIMMER'S PROPULSION AID

FIELD OF THE INVENTION

This invention relates to means to be used by a swimmer as an aid to propelling the swimmer through the water. More particularly, the invention relates to light-weight means to be worn on the feet of an untrained or experienced swimmer to assist in propelling such swimmer through the water or to be used in emergency situations to enable the propelling of a swimmer through the water more rapidly over greater distances with a minimum of effort.

BACKGROUND OF THE INVENTION

For many years there has been a developing interest in swimming appliances and aids. Particular attention has been given by swimmers to the design and development of foot gear for use in swimming. One approach to increasing the forward push or thrusting action obtainable from a swimmers legs and feet has been the provision of swimming shoes. Swimming shoes of one general type have lateral wings that swing outwardly into the plane of the shoe's sole during the push or thrust portion of a stroke of the swimmer's leg and that swing toward each other and reside rearwardly of the borders of the shoe sole during the forward or retracting portion of the swimmer's leg stroke so that little or no resisting surfaces of the wings are presented to the water during this movement of the swimming stroke. Examples of this form of swimmer's foot gear are shown in U.S. Pat. No. 1,043,776 granted to G. M. Larson, U.S. Pat. No. 1,506,885 granted to A. Cech and U.S. Pat. No. 1,626,541 granted to J. P. LaRosa. Each of these patents show devices that include swimming shoes that are affixed to a central board or platform with the side wings hinged to the edges thereof. Each patent also shows a means for inhibiting the outward swing of the wings beyond their thrust orientation in the plane of the sole of the swimming shoe or in the plane of the central board or platform to which the shoe is affixed. The swimming shoe devices of the above noted patents are heavy, cumbersome and unwieldly and they include thrust wings on the inside of the swimmer's feet which frequently come into contact with each other during the pushing portion of the leg stroke.

Another approach to the provision of swimming shoe designs has been proposed in U.S. Pat. No. 1,626,175 granted to J. Zimmer and U.S. Pat. No. 1,983,609 granted to W. T. Hudson. In these patents lateral thrust wings are affixed in hinged manner to the shoe sole along the central longitudinal axis of the sole or to a central plate or platform along the central longitudinal axis thereof with the swimmer's foot strapped to such plate or platform. Again, these swimming aids, applied to the swimmer's feet, are heavy, cumbersome and unwieldy and include inside lateral wings which frequently come into interfering contact with each other during the pushing portion of the leg strokes.

A still further design for foot gear for use in swimming has been proposed by P. J. Griffin in his U.S. Pat. No. 719,583 wherein lateral water thrust wings are hinged to a beam which is attached to and projects from an anklet ring worn on the swimmer's leg above each ankle. The beam on each of the swimmer's legs extends forwardly from the shin area above the ankle with the lateral wings moving outwardly above the forward portion and toes of each foot during leg thrust motion and inwardly and downwardly to the foot during the retracting portion of each leg stroke. The Griffin swimming gear requires that a strut extend from a metallic portion of a foot socket to the beam supporting the thrust wings to maintain such beam in its forwardly extending orientation from the swimmer's leg. As in the case of the previously described patented swimming aids, the Griffin gear is heavy, cumbersome and unwieldy with the inside thrust wings of each foot-borne structure often interfering with each other.

It is an object of the present invention to provide a swimming propulsion aid for attachment to each foot of a swimmer with the aid being of light-weight construction and adapted for rapid attachment to the swimmer's foot.

It is another object of the invention to provide a pair of light-weight swimming propulsion aids for rapid attachment to the feet of an untrained or experienced swimmer to assist in propelling such swimmer through the water with a minimum of effort.

It is a still further object of the invention to provide light-weight swimming propulsion aids for rapid assembly and attachment to the feet of a swimmer in emergency situations to enable the propelling of such swimmer through the water more rapidly over greater distances with a minimum of reciprocating leg-foot stroke action and effort.

It is yet another object of the invention to provide a pair of light-weight swimming propulsion aids for rapid attachment to the feet of a swimmer with such aids being oriented so as to not interfere with one another during alternating and reciprocating leg-foot stroke action by the swimmer.

Other objects and advantages of the invention will become apparent from the following summary and detailed description of preferred embodiments of the invention taken in conjunction with the accompanying drawing figures.

SUMMARY OF THE INVENTION

The present invention relates to a pair of swimming propulsion aids for attachment to the feet of a swimmer under normal swimming or emergency swimming conditions with the aids or devices being of light-weight construction and capable of rapid assembly from pre-use compact stored or packaged components. The assembled swimming aid for each foot provides a lateral foot wing that swings outwardly from the inside of the foot into a plane of the swimmer's foot sole during the push or thrust portion of a reciprocating stroke of the swimmer's leg. Thereafter, the foot wing swings to a position of general alignment with the swimmer's leg and inner foot edge during the forward or retracting portion of the swimmer's leg stroke so that little or no force-resisting surface of the wing is presented to the water during this portion of the leg-foot stroke of the swimming action.

In accordance with the invention the outside lateral foot wing of the swimming aid structure or assembly for each foot is comprised of a strong fabric or flexible plastic component of generally rectangular configuration supported on and by a collapsible outer frame and foot encompassing straps which affix the right or left side foot wing to the appropriate foot. The straps position the wings so that the inside edge of each wing pivots on the straps at points that define a pivot axis aligned with the inside of the swimmer's foot. During each push or thrust portion of a reciprocating stroke of the swimmer's leg the foot wing swings outwardly under the foot and projects across the plane of the foot sole extending outwardly thereof to provide a greatly enlarged thrust area for pushing action with respect to the surrounding water. With retracting movement of the swimmer's leg and foot the foot wing pivots inwardly with the wing moving into near longitudinal alignment with the leg and inner foot edge. The foot straps are also provided with means for stopping the movement of the foot wing during the leg retracting movement so that the wing does not swing to a position of absolute alignment with the leg so that during the push or thrust portion of the reciprocating stroke of the leg the wing will always move outwardly to its thrust position with respect to the surrounding water. A preferred form of fastener system for the straps of the foot wings is the Velcro hook and eye material.

In an alternative form of the lateral foot wings of the swimming propulsion aids of the invention each foot wing is comprised of a light-weight, generally rectangular frame across which extend pivotal louvers in parallel orientation with respect to the long axis of the swimmer's foot. During each push or thrust portion of a reciprocating stroke of the swimmer's leg the louvers of the foot wing assume a closed position and thereby present a fully closed thrust area for pushing action with respect to the surrounding water. With retracting movement of the swimmer's leg and foot the louvers of the foot wing open to eliminate the closed thrust area so that the swimmer's foot and leg can be fulley retracted without being impeded by the surrounding water environment.

BRIEF DESCRIPTION OF THE DRAWING FIGURES

FIG. 1 is a side view showing a pair of the swimming propulsion aids of the invention in use upon the feet of a swimmer;

FIG. 2 is a perspective view of a pair of the swimming propulsion aids in collapsed and rolled storage form;

FIG. 3 is a top plan view of the left side swimming propulsion aid of the invention with a swimmer's left foot shown in phantom in its position for attachment of the swimming aid by the foot and ankle straps thereof;

FIG. 4 is a a front side or edge view of the swimming propulsion aid of FIG. 3;

FIG. 5 is a front side or edge view of the swimming propulsion aid of FIGS. 3 and 4 strapped to a swimmer's left foot and with the foot wing of the propulsion aid in its retracted position;

FIG. 6 is an inside side view of the swimming propulsion aid of FIGS. 3 and 4 in the retracted orientation of FIG. 5;

DETAILED DESCRIPTION OF THE PREFERRED EMBODIMENTS

Figure 7:
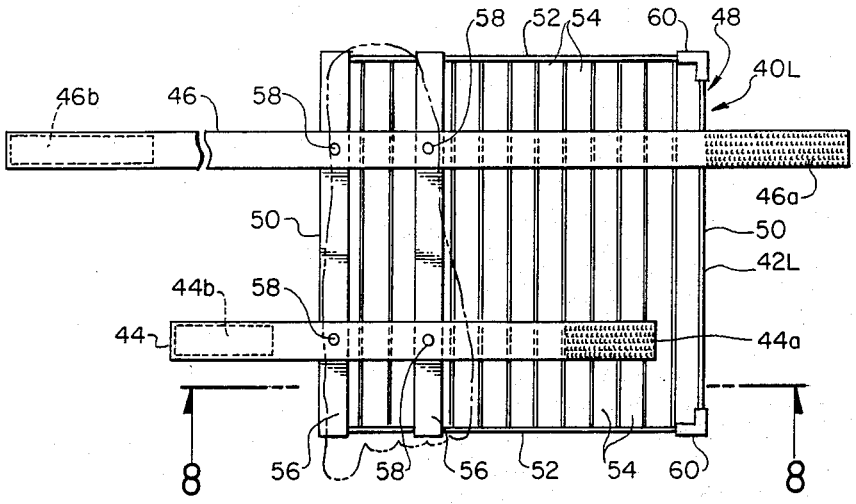
FIG. 7 is a top plan view of the left side unit of an alternative louvered form of the swimming propulsion aid of the invention with a swimmer's left foot shown in phantom in its position for attachment of the swimming aid by the foot and ankle straps thereof.

Referring initially to FIG. 1 there is illustrated a swimmer utilizing a pair of the swimming propulsion aids 10L and 10R of the invention mounted to the feet of the swimmer. As shown, the swimmer has just completed with his right leg the push or thrust portion of a reciprocating leg stroke so that the foot wing 12R of propulsion aid 10R is extended laterally and outwardly under the right foot and across the plane of the foot sole to provide an enlarged thrust area for pushing action with respect to the surrounding water. The swimmer's left leg is in the process of completing a retracting movement and the pivotal foot wing 12L is in its inward position in the near longitudinal alignment with the left leg and inner edge of his left foot so that the only area inhibiting forward (retracting) movement of the left foot is the upper foot surface itself. Each of the swimming propulsion aids is maintained on the swimmer's foot by foot straps 14 and ankle straps 16.

In FIGS. 3 and 4 there is shown, in a top plan view and in a front side or edge view, respectively, the left side swimming propulsion aid 10L of the invention with a swimmer's left foot shown in phantom in its position for attachment of the foot wing 12L by a foot strap 14 and ankle strap 16. The foot wing 12L is comprised of a collapsible rectangular wing frame 18, including opposite side frame members 20 aligned with the swimmer's foot and connecting bifurcated top and bottom frame members 22, and a strong fabric (or flexible sheet plastic) wing material 24 which creates the enlarged thrust area of the propulsion aid. The bifurcated top and bottom frame members 22 are formed of frame parts **22*a* and 22*b* which are locked in their extended orientation (as shown in FIG. 3) by snap-lock components 22*c* (of known design) formed at the end of frame part 22*b* with the inward ends of frame parts 22*a* and 22*b* connected by central pivots 22*d*. The outer ends of frame parts 22*a* and 22*b* are connected to the ends of side frame members 20 by corner pivots 20*a*. Upon the application of inward pressure to the bifurcated top and bottom frame members 22 at their respective central pivots 22*d* the frame parts 22*a* and 22*b* fold inwardly to collapse the frame into a compact orientation and structure and, with the fabric wing material 24 wrapped therearound and secured by straps 14 and 16, the pair of propulsion aids 10L and 10R may take a convient packaged or storage form 26 as shown in FIG. 2**.

The fabric (or flexible sheet plastic) material 24 which creates the enlarged thrust area of each propulsion aid is maintained on rectangular wing frame 18 by triangular corner pockets **24*a* of like fabric or sheet plastic material. The fabric or sheet plastic material forming the triangular corner pockets 24*a* may be sewn, heat welded or otherwise affixed to the thrust area material 24. The foot and ankle straps 14 and 16 may be of any suitable flexible fabric (such as canvas) or plastic material. They are affixed to material 24 of each foot wing (12L or 12R) by hinge strips 28 and 30 which are sewn or welded to the foot and ankle straps and to material 24. End portions 14*a* and 14*b* of foot strap 14 and end portions 16*a* and 16*b* of ankle strap 16 are provided with mating Velcro type fastening means whereby when such straps are appropriately wrapped around the foot and ankle of a swimmer (see FIGS. 5 and 6) the mating Velcro hook and eye fasteners interact in well known fashion to secure the straps, and thus the propulsion aid, in place. The foot strap 14 and ankle strap 16 are each provided with additional swing limit strips 32 and 34, respectively, which connect such straps to the wing material 24 (see particularly FIG. 5 for a showing of strip 32 connecting strap 14 to the wing material). The purpose of strips 32 and 34 is to limit the swing of foot wing 12L (and 12R) from its water thrust position shown in phantom in FIG. 5 to its retracting position of near longitudinal alignment with the swimmer's leg and inner edge of his foot as shown in full line illustration in FIG. 5. Thus, upon any pushing or thrusting motion of the swimmer's foot the foot wing will always swing to its proper lateral position in a plane across the foot sole and outwardly of the foot (phantom position of FIG. 5). The swing limit strips 32 and 34 may be affixed to their respective straps 14 and 16 and to the wing material 24** by any appropriate means (sewing, welding, etc.).

FIG. 6 is an inside side view of the swimming propulsion aid of FIGS. 3 and 4 in the retracted orientation of FIG. 5. This figure clearly shows the manner in which foot strap 14 surrounds the forward portion of the swimmer's left foot with the mating Velcro fastener means **14*a* and 14*b* interacting at the top of the foot to close such strap and maintain same around the foot to hold the forward portion of foot wing 12L in proper position and alignment with the inner edge of the foot. The elongated ankle strap 16 is shown to have its ends each crossing over the foot and thence encircling the swimmer's leg (preferably above the ankle) with the mating Velcro fastener means 16*a* and 16*b* interacting at the rear of the leg to close such strap and maintain same around the foot and leg to hold the rearward portion of foot wing 12L** in proper position and alignment with the inner edge of the foot.

The above described embodiment of the swimming propulsion aid of the invention is easily assembled from a packaged or stored assemblage of its components. With the wing frame 18 extended and wing material 24 in place as shown in FIG. 3, the swimming aid for each foot can be easily affixed thereto for recreational swimming purposes or in emergency situations. The weight of each swimming aid unit is minimal so as not to tire the swimmer and the thrusting or pushing leg action of the swimmer causes the foot wing to move outwardly across the sole of the swimmer's foot so that the foot wings on each foot do not interfere with one another.

Figure 8:
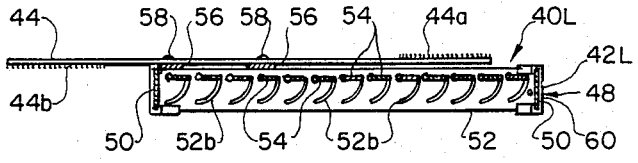
FIG. 8 is a front side or edge view of the alternative louvered form swimming propulsion aid of FIG. 7.

An alternative form of the swimming propulsion aids of the invention is shown in FIGS. 7 and 8. FIG. 7 is a top plan view of the left side unit 40L of a pair of swimming aids wherein the swimmer's left foot is shown in phantom in its position for attachment to the foot wing 42L by a foot strap 44 and an ankle strap 46. The foot wing 42L is comprised of rectangular wing frame 48, including rigid opposite side frame members 50 aligned with the swimmer's foot and connecting rigid top and bottom frame members 52, and a parallel array of pivotal louvers 54 extending between the top and bottom frame members 52. The louvers 54 are pivoted at their ends as shown in detail in FIG. 9 as discussed hereinafter. When louvers 54 are pivoted to their closed position as shown in FIGS. 7 and 8, they create the enlarged thrust area of the swimming propulsion aid in accordance with the invention. Thus, during each push or thrust portion of a reciprocating stroke of the swimmer's leg the louvered foot wing 42L (with its louvers closed) resides outwardly under the foot and projects across the plane of the foot sole extending outwardly thereof to provide a fully closed thrust area for pushing action with respect to the surrounding water. With retracting movement of the swimmer's leg and foot the louvers open so that water resistance to the foot wing during such movement is eliminated and the wing and swimmer's foot move freely throughout the retracting portion of the stroke cycle.

As shown in FIGS. 7 and 8, the wing frame 48 also has extending between its top and bottom frame members 52 a pair of parallel rigid foot support members 56 appropriately affixed at their ends to frame members 52. The foot strap 44 and ankle strap 46 are affixed to foot support members 56 by rivets 58 or other suitable means. Straps 44 and 46 (of any suitable fabric of flexible plastic material) are provided at their respective end portions **44*a* and 44*b* and 46*a* and 46*b* with mating Velcro type fastening means as described with respect to staps 14 and 16 of FIGS. 3 and 4 and the straps 44 and 46** maintain each right and left swimming propulsion aid to a foot of the swimmer as also described with respect to such figures.

Figure 9:
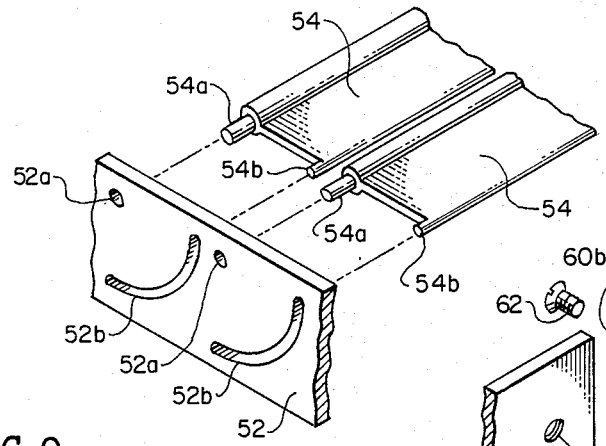
FIG. 9 is an enlarged perspective view of the ends of several louvers of the swimming aid of FIG. 7 prior to their insertion into a section of the edge frame of the lateral wing of such aid.

The louvers 54 of the foot wing 42L of FIGS. 7 and 8 are shown in greater detail in the enlarged perspective view of FIG. 9. In such figure the ends of several louvers are shown, with their pivot pin **54*a* and slide pin 54*b*, in exploded fashion in alignment with the pivot pin holes 52*a* and slide pin grooves 52*b* of member 52. With the thrusting or pushing action of the swimmer's leg and foot on the foot wing 42L the louvers assume a closed position with the slide pin 54*b* forced against the upper end of the arcuate slide pin groove 52*b*. During the retracting action of the swimmer's leg and foot the slide pin 54*b* slides to the lower end of groove 52*b* with each louver 54** assuming an open position so that water may flow freely between the louvers.

Figure 10:
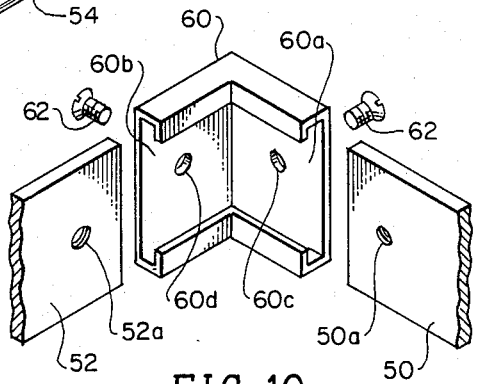
FIG. 10 is an enlarged perspective view of the corner section of the dismantlable frame of the lateral wing of the swimming propulsion aid of FIGS. 7 and 8.

The swimming propulsion aid 40L of FIGS. 7 and 8 is preferably constructed in such a manner so that it may be easily assembled and dismantled by the user. In FIG. 10 there is illustrated, in an enlarged perspective view, the corner structure of the frame 48 of the louvered foot wing 42L of FIGS. 7 and 8. Thus, there may be provided at each corner of frame 48 a right angle corner channel piece 60 presenting internal channels **60*a* and 60*b* into which the end of a side frame member 50 and the end of a top or bottom frame member 52 may be inserted. After their insertion in corner channel piece 60, the frame members 50 and 52 may be retained therein by threaded stub bolts 62 which are inserted through holes 60*c* and 60*d* in the outer walls of channels 60*a* and 60*b*, respectively, and thence threaded into threaded holes 50*a* and 52*a* of the frame members 50 and 52, respectively. The rigid foot support members 56 may be affixed by a folded portion at their ends to frame top and bottom members 52** by bolt means (not shown).

It is to be noted that although the alternative form of foot wing 42L, as shown in FIGS. 7 and 8, does not itself pivot or swing to a near longitudinal alignment with the swimmer's leg and inner foot edge during retraction movement of the swimmer's leg, the individual louvers 54 of foot wing 42L do pivot or swing to such alignment position during such leg retraction movement. Thus, the effective cyclic action of louvered foot wing 42L is equivalent to the cyclic action of foot wing 12L (FIGS. 3 and 4). It is also to be re-emphasized that the swimming propulsion aids of the present invention are readily dismantlable for convenient and compact storage and such aids are designed for rapid assembly and application to a swimmer's feet for swimming recreation purposes and in emergency situations.

While the present invention has been described with reference to preferred embodiments thereof, it is obvious that modifications and alterations of such embodiments will occur to others skilled in the art upon their reading and understanding of this specification. It is therefore to be understood that the present invention includes all such modifications and alterations, and equivalents thereof, being limited only by the scope of the following claims.

What I claim is:

1. In a swimming propulsion aid: a foot wing adapted to be secured to the foot of a swimmer by a foot strap affixed to said wing for surrounding attachment to the forward portion of the swimmer's foot and by an ankle strap affixed to said wing rearwardly of said foot strap for surrounding attachment to the rearward portion of the swimmer's foot and ankle whereby said wing extends from the inner edge of the foot laterally under the foot sole and outwardly therefrom to provide an enlarged and effective thrust area for pushing action with respect to surrounding water during the leg extension portion of a reciprocating leg stroke by the swimmer; and wing pivot means aligned with the inside of the swimmer's foot comprising the foot strap and ankle strap at the point whereat said straps are affixed to said foot wing so that during the retracting portion of said leg stroke the foot wing swings inwardly into near longitudinal alignment with the leg and inner foot edge of the swimmer whereby upon alternating leg strokes the swimmer is more effectively and forcefully propelled through the water.

2. In a swimming propulsion aid as claimed in claim 1 wherein the foot strap and ankle strap affixed to the foot wing each include end portions respectively of sufficient length to surround the forward portion of the swimmer's foot and connectively mate atop said foot and of sufficient length to surround the rearward portion of the swimmer's foot, cross around the swimmer's ankle and connectively mate behind the swimmer's leg.

3. In a swimming propulsion aid as claimed in claim 2 wherein the foot strap and ankle strap affixed to the foot wing in their respective end portions terminate in mating Velcro fastener means.

4. In a swimming propulsion aid as claimed in claim 1 wherein said foot wing is substantially rectangular in configuration and formed of a wing frame over which is stretched flexible sheet material.

5. In a swimming propulsion aid as claimed in claim 4 wherein the wing frame of said foot wing is collapsible for compact storage.

6. In a swimming propulsion aid as claimed in claim 1 wherein said foot wing is provided with swing limit strips extending from said foot strap and said ankle strap to said foot wing to limit the swing of the foot wing from its water thrust position to its retracting position of near longitudinal alignment with the swimmer's leg and inner foot edge whereby upon thrust motion of the swimmer's foot wing the foot wing swings to its lateral position across the foot sole and outwardly of the foot.

* * * * *